US005490724A

United States Patent [19]

Domenig

[11] Patent Number: 5,490,724

[45] Date of Patent: Feb. 13, 1996

[54] DRAWER GUIDE FOR SUPPORTING A MOVEABLE STRUCTURE SUCH AS A DRAWER IN A FURNITURE ARTICLE

[75] Inventor: Georg Domenig, Kernersville, N.C.

[73] Assignee: Grass America, Inc., Kernersville, N.C.

[21] Appl. No.: 327,034

[22] Filed: Oct. 21, 1994

[51] Int. Cl.[6] ..... A47B 88/10

[52] U.S. Cl. ..... 312/334.45; 312/334.19; 312/334.18; 312/334.21; 312/334.41; 312/333; 312/334.44

[58] Field of Search ..... 312/334.18, 334.19, 312/334.21, 333, 334.41, 334.42, 334.44, 334.45

[56] References Cited

U.S. PATENT DOCUMENTS

| | | | |
|---|---|---|---|
| 2,293,210 | 8/1942 | Marzolf | 312/334.19 |
| 2,859,070 | 11/1958 | Gomersall | 312/333 X |
| 3,053,582 | 9/1962 | Wenger | 312/333 X |
| 3,099,501 | 7/1963 | Hillson et al. | 312/334.21 X |
| 3,352,617 | 11/1967 | Dargene | 312/334.19 |
| 3,387,907 | 6/1968 | Wall | 312/334.41 |
| 3,664,716 | 5/1972 | Johnson | 312/334.19 X |
| 3,954,315 | 5/1976 | Sanden | 312/334.19 X |
| 3,973,814 | 8/1976 | Entrikin | 312/333 |
| 4,315,661 | 2/1982 | Kessler | 312/334.19 |
| 4,447,095 | 5/1984 | Fielding | 312/334.18 X |

FOREIGN PATENT DOCUMENTS

| | | | |
|---|---|---|---|
| 2237597 | 2/1975 | France | 312/334.44 |
| 702906 | 1/1954 | United Kingdom | 312/334.19 |

*Primary Examiner*—Peter M. Cuomo
*Assistant Examiner*—Rodney B. White
*Attorney, Agent, or Firm*—Petree Stockton

[57] ABSTRACT

A drawer guide for supporting a moveable structure such as a drawer in a furniture article includes a guide rail having a rotatable guide rail roller, which guide rail is mountable to the furniture article in a generally horizontally disposed position, and a pull-out rail for carrying the moveable structure, which pull-out rail has a pull-out rail upper ledge in rolling contact with the guide rail roller enabling forward and rearward horizontal movement of the pull-out rail and carried structure, and the pull-out rail is provided with a pull-out rail retaining member engaging the guide rail roller in a rearward position of the pull-out rail resisting forward movement of the pull-out rail.

10 Claims, 2 Drawing Sheets

DRAWER GUIDE FOR SUPPORTING A MOVEABLE STRUCTURE SUCH AS A DRAWER IN A FURNITURE ARTICLE

BACKGROUND OF THE INVENTION

1. Field of the Invention

The present invention relates to a pull-out guide for a drawer or the like and more particularly, to a new and improved drawer guide for supporting a moveable structure such as a drawer in a furniture article, the drawer guide including a guide rail having a rotatable guide rail roller, which guide rail is mountable to the furniture article in a generally horizontally disposed position, and a pull-out rail for carrying the moveable structure, which pull-out rail has a pull-out rail upper ledge in rolling contact with the guide rail roller enabling forward and rearward horizontal movement of the pull-out rail and carried structure, and the pull-out rail is provided with a pull-out rail retaining member engaging the guide rail roller in a rearward position of the pull-out rail resisting forward movement of the pull-out rail.

2. Description of the Prior Art

Various types of pull-out drawer guides have been used in furniture such as cabinets, desks and the like for supporting drawers and similar moveable structures for many years. One such type of drawer guides has guide rails mountable to the furniture article and pull-out rails carrying the moveable structure, both of which are provided with rollers. The pull-out rail may support a drawer, a bin, a board or the like, and the respective rollers enable the pull-out guide and carried structure to be moved freely and without resistance between a forward, open position and a rearward, closed position.

A disadvantage of such type of drawer guides is that there is nothing to prevent accidental opening of the closed drawer during normal use, and moreover, there is nothing to prevent the drawer from falling completely out when the furniture article is tipped over from a normally disposed vertical position, for example, by accidental upsetting of an unanchored cabinet such as a roll-around type cabinet or, for example, during handling and shipping of a cabinet.

There is a current need to provide a pull-out drawer guide which prevents accidental opening of the closed drawer during normal use and also prevents the drawer from falling out when the furniture article is tipped over, while retaining the simplicity and costs associated with the design and manufacture of such drawer guides within the same range as presently experienced with conventional drawer guides.

While improved pull-out drawer guides of the type disclosed in U.S. Pat. No. 4,564,248, which provides parallel run-in slopes on the guide rail and the pull-out rail to enable self-closing under the weight of the pull-out rail and carried drawer, partially address this need, the usefulness of such drawer guides is limited in that the design of such pull-out drawer guides provides little, if any, resistance to accidental opening under normal conditions, and more importantly, such drawer guides cannot prevent the drawer from opening or falling out when the furniture article is tipped over from a normally disposed vertical upright position.

The present invention addresses this need and provides a pull-out drawer guide for use in a furniture article which is designed to resist forward movement of the pull-out rail in the rearward, closed position of the pull-out rail and carried drawer, preventing accidental opening under normal conditions and preventing the drawer from opening or falling out when the furniture article is tipped from an upright position.

SUMMARY OF THE INVENTION

The general purpose of the present invention, which will be described in greater detail, is to provide a new and improved pull-out drawer guide for use in a furniture article which has all, and more, of the advantages of the prior art and none of the disadvantages.

To attain this purpose, representative embodiments of the present invention are illustrated in the drawings. The drawer guide of the present invention makes use of a guide rail having a rotatable guide rail roller which is mountable to a furniture article in a generally horizontally disposed position, and a pull-out rail for carrying a moveable structure such as a drawer. The pull-out rail has a pull-out rail upper ledge in rolling contact with the guide rail roller enabling forward and rearward horizontal movement of the pull-out rail and carried drawer.

The guide rail roller is mounted proximate the front end of the guide rail, and the pull-out rail is provided with a pull-out rail retaining member, preferably formed in the pull-out rail upper ledge proximate the front end of the pull-out rail, which engages the guide rail roller in a rearward position of the pull-out rail resisting forward movement of the pull-out rail. When so engaged, the pull-out rail retaining member prevents accidental opening of the closed drawer and prevents the drawer from opening or falling out when the furniture article is tipped from a normally disposed upright vertical position.

The guide rail also has a guide rail lower ledge, and the pull-out rail is provided with a rotatable pull-out rail roller mounted proximate the rear end of the pull-out rail, which is in rolling contact with the guide rail lower ledge. The pull-out rail upper ledge can be configured with an obliquely disposed pull-out rail upper ledge run-in slope associated with the pull-out rail retaining member, and the guide rail lower ledge can likewise be configured with an obliquely disposed guide rail lower ledge run-in slope proximate the rear end of the guide rail and substantially parallel to the pull-out rail upper ledge run-in slope. Thus, when the pull-out rail and carried drawer are moved in a rearward direction, as the pull-out rail roller and the guide rail roller reach the respective run-in slopes, the rollers roll down into lower areas of the respective run-in slopes under the weight of the drawer, automatically closing the drawer.

The pull-out rail has a generally Z-shaped cross section and the guide rail has a generally C-shaped cross section. The pull-out rail upper ledge may include a downwardly depending pull-out rail upper ledge flange engaging the guide rail roller, and the guide rail lower ledge may include an upwardly extending guide rail lower ledge flange engaging the pull-out rail roller. The pull-out rail upper ledge flange prevents the pull-out rail upper ledge from becoming disengaged from the guide rail roller, and the guide rail lower ledge flange prevents the guide rail lower ledge from becoming disengaged from the pull-out rail roller, for example, when a lateral force is applied to the drawer carried by the pull-out rail.

The guide rail also includes a guide rail upper ledge which engages the pull-out rail roller in a forward position of the pull-out rail to prevent the front end of the pull-out rail and carried drawer from pivoting in a downward direction under the weight of the drawer in an open position of the drawer. The guide rail upper ledge is also configured with a run-in slope disposed proximate the rear end of the guide rail substantially parallel to the run-in slopes of the guide rail lower ledge and the pull-out rail upper ledge. The guide rail upper ledge may also have a downwardly depending guide rail upper ledge flange which cooperates with the guide rail lower ledge flange to prevent disengagement of the pull-out rail roller when a lateral force is applied to the drawer carried by the pull-out rail.

To limit further rearward movement of the pull-out rail and carried drawer in a rearward, closed position of the drawer, the guide rail may be provided with a guide rail stop member formed in the guide rail lower ledge proximate the rear end of the guide rail, which engages the pull-out rail roller in the closed position of the drawer.

This outline focuses on the more important features of the invention in order that a detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and being carried out in various ways.

It is to be further understood that the phraseology and terminology employed herein are for the purpose of description and are not to be regarded as limiting. Those skilled in the art will appreciate that the conception upon which this disclosure is based may readily be utilized as a basis for designing the structures, methods and systems for carrying out the several purposes to the present invention. The claims are regarded as including such equivalent constructions so long as they do not depart from the spirit and scope of the present invention.

From the foregoing summary, it is apparent that an object of the present invention is to provide a new and improved pull-out drawer guide for supporting a moveable structure such as a drawer in a furniture article which has all, and more, of the advantages of prior art drawer guides and none of the disadvantages.

It is another object of the present invention to provide a new and improved design for a pull-out drawer guide that is more reliable and functional than those presently available.

Yet another object of the present invention is to provide a pull-out drawer guide which is designed to resist accidental opening of the closed drawer and to prevent the drawer from opening or falling out when the furniture article is tipped from a normally disposed upright position.

Still another object of the present invention is to provide a pull-out drawer guide which provides self-closing of the drawer.

A further object of the present invention is to provide a pull-out drawer guide in which the pull-out rail cannot be disengaged from the pull-out rail by a lateral force applied to the drawer carried by the pull-out rail.

A still further object of the present invention is to provide a pull-out drawer guide utilizing a guide rail stop limiting rearward movement of the pull-out rail and carried drawer in a rearward, closed position of the drawer.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
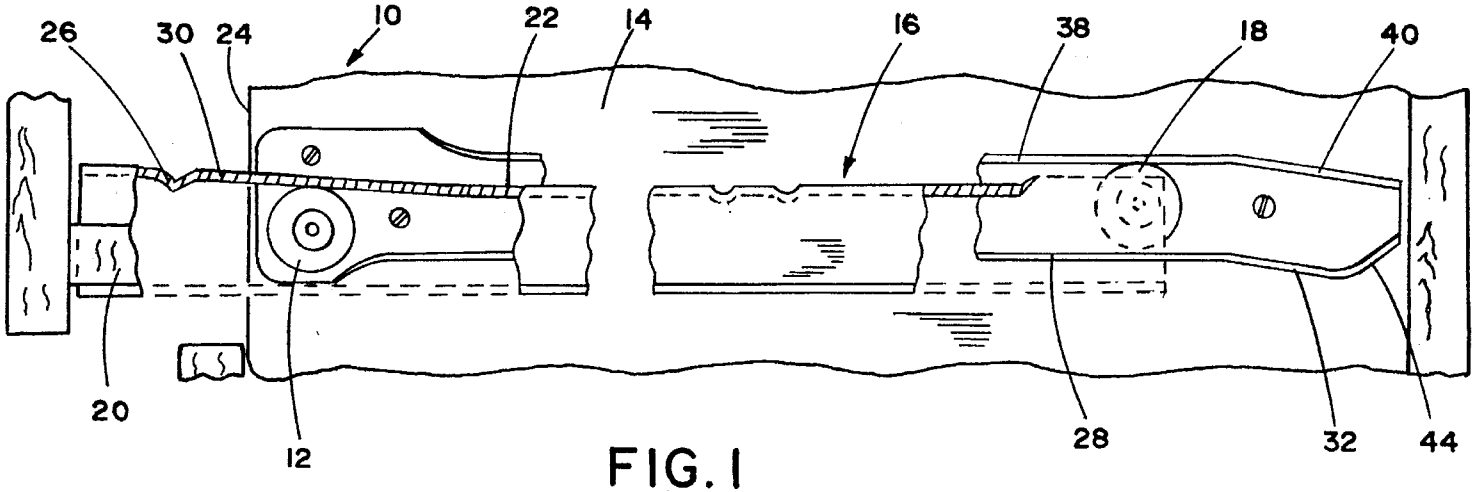
FIG. 1 is a side elevational view of the drawer guide of the present invention with portions of the pull-out rail removed to show the guide rail and with the pull-out rail in a forward, partially open position.

Referring now to the drawings, and specifically to FIG. 1, the drawer guide of the present invention includes a guide rail shown generally as 10 mountable to a sidewall 14 of a furniture article such as a desk or cabinet in a generally horizontally disposed position. Guide rail 10 has a rotatable guide rail roller 12 mounted in a front end area of guide rail 10. The drawer guide also includes a pull-out rail shown generally as 16 for carrying a moveable structure such as a drawer 20. Pull-out rail 16 has a rotatable pull-out rail roller 18 mounted in a rear end area of pull out rail 16. Pull-out rail 16 is provided with a pull-out rail upper ledge 22 in rolling contact with guide rail roller 12 to enable forward and rearward horizontal movement of pull-out rail 16 and carried drawer 20 relative to guide rail 10.

Figure 2:
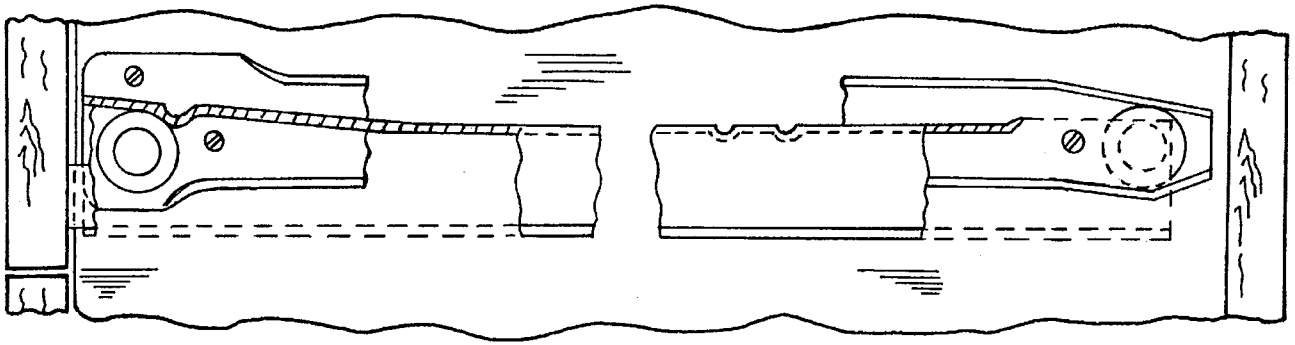
FIG. 2 is a side elevational view of the drawer guide shown in FIG. 1 with the pull-out rail in a rearward, closed position.

Guide rail roller 12 is positioned proximate the front end of guide rail 10, which is in turn mountable to sidewall 14 in the area of face frame 24 of the furniture article. Pull-out rail 16 is provided with a pull-out rail retaining member 26, preferably formed in pull-out rail upper ledge 22 proximate the front end of pull-out rail 16. Pull-out rail retaining member 26 is disposed in pull-out rail upper ledge 22 to engage guide rail roller 12 in a rearward position of pull-out rail 16 as shown in FIG. 2. When guide rail roller 12 is so engaged, forward movement of pull-out rail 16 and carried drawer 20 is resisted, preventing drawer 20 from accidentally opening or falling out when the furniture article is tipped from a normally disposed upright vertical position.

Guide rail 10 also has a guide rail lower ledge 28 in rolling contact with pull-out rail roller 18. Pull-out rail upper ledge 22 can be provided with an obliquely disposed pull-out rail upper ledge run-in slope 30 associated with pull-out rail retaining member 26 in a front end area of pull-out rail 16. Guide rail lower ledge 28 can likewise be provided with an obliquely disposed guide rail lower ledge run-in slope 32 in a rear end area of guide rail 10 and substantially parallel to pull-out rail upper ledge run-in slope 30. When pull-out rail 16 and carried drawer 20 are moved in a rearward direction, as pull-out rail roller 18 and guide rail roller 12 reach guide rail lower ledge run-in slope 32 and pull-out rail upper ledge run-in slope 30 respectively, pull-out roller 18 rolls down into a lower area of guide rail lower ledge run-in slope 32, and pull-out rail upper ledge run-in slope 30 rolls on guide rail roller 12 to a lower position, under the weight of drawer 20, automatically closing drawer 20 with pull-out retaining member 26 engaged by guide rail roller 12.

Figure 3:
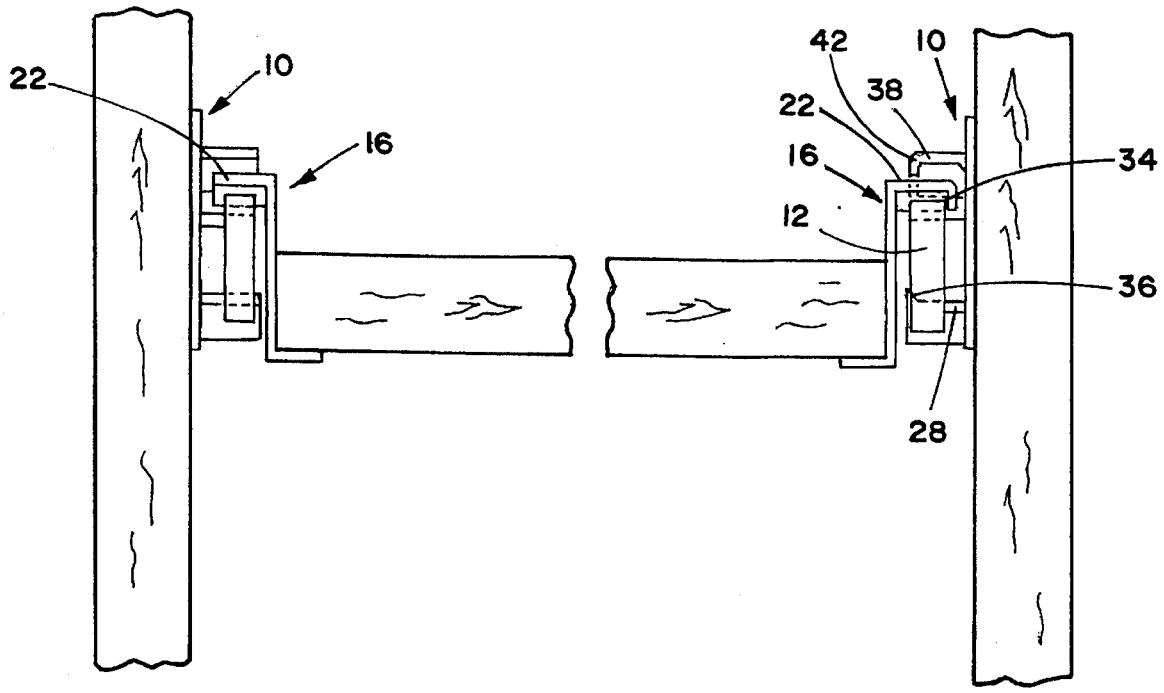
FIG. 3 is a front elevational view of a drawer carried by the drawer guide shown in FIG. 1 in a rearward, closed position.

As shown in FIG. 3, pull-out rail 16 has a generally Z-shaped cross section, and guide rail 10 has a generally C-shaped cross section. Pull-out rail upper ledge 22 may include a downward depending pull-out rail upper ledge flange 34 which engages guide rail roller 12, and guide rail lower ledge 28 may include an upwardly extending guide rail lower ledge flange 36 which engages pull-out rail roller 18. Thus, when a lateral force is applied to drawer 20 carried by pull-out rail 16, pull-out rail upper ledge flange 34 prevents pull-out rail 16 from becoming disengaged from guide rail roller 12, and guide rail lower ledge flange 36 prevents guide rail 10 from becoming disengaged from pull-out rail roller 18.

Guide rail 10 also includes guide rail upper ledge 38, as shown in FIG. 1, which engages pull-out rail roller 18 in a forwardly disposed position of pull-out rail 16 relative to guide rail 10 to prevent the front end of pull-out rail 16 and carried drawer 20 from pivoting in a downward direction under the weight of drawer 20 in a fully open position of drawer 20. Guide rail upper ledge 38 is also provided with a run-in slope 40 disposed in a rear end area of guide rail 10 substantially parallel to guide rail lower ledge run-in slope 32 and pull-out rail upper ledge run-in slope 30. Guide rail upper ledge 38 may also be provided with a downwardly depending guide rail upper ledge flange 42, as shown in FIG. 3, which cooperates with the guide rail lower ledge flange 36 to prevent disengagement of pull-out rail roller 18 when a lateral force is applied to drawer 20 carried by pull-out rail 16.

In order to limit further rearward movement of pull-out rail 16 and carried drawer 20 in a rearwardly disposed closed position of drawer 20, guide rail 10 may be provided with a guide rail stop member 44 formed in guide rail lower ledge 28 in a rear end area of guide rail 10, which is configured to engage pull-out rail roller 18 in the closed position of drawer 20.

Obviously, any number of materials may be used to form the guide rail and its components described herein, and exceptional success has been experienced by the use of metal for the guide rail and pull-out rail and a semi-rigid, resilient material for the rolling surface of the guide rail roller and pull-out rail roller, although other materials may be utilized.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and change will readily occur to those skilled in the art, it is not intended to limit the invention to the exact construction and operation shown and described, and all suitable modifications and equivalents falling within the scope of the appended claims are deemed within the present inventive concept.

What is claimed is:

1. Drawer guide for supporting a moveable structure such as a drawer in a furniture article comprising:

a guide rail having front and rear ends and mountable to a furniture article in a horizontally disposed position of the guide rail, the guide rail having a guide rail roller rotatably mounted;

a pull-out rail having front and rear ends for carrying the moveable structure in a horizontally disposed position of the pull-out rail, the pull-out rail having a pull-out rail upper ledge in rolling contact with the guide rail roller enabling movement of the pull-out rail and carried structure between forward and rearward positions relative to the guide rail, the pull-out rail having a pull-out rail retaining member engaging the guide rail roller in the rearward position of the pull-out rail resisting forward movement of the pull-out rail relative to the guide rail, the pull-out rail upper ledge including a bend spaced from the pull-out rail front end and having an obliquely disposed pull-out rail upper ledge roll-in slope extending from the bend toward the pull-out rail front end in an upwardly inclined direction, the pull-out rail retaining member being formed in said pull-out rail upper ledge roll-in slope as a downwardly extending protrusion spaced between the bend and the pull-out rail front end, and the pull-out rail retaining member engaging the guide rail roller in the rearward position of the pull-out rail with the guide rail roller disposed between the pull-out rail retaining member and the pull-out rail front end.

2. The drawer guide as claimed in claim 1, said guide rail having a guide rail lower ledge, and said pull-out rail having a pull-out rail roller rotatably mounted in rolling contact with the guide rail lower ledge.

3. The drawer guide as claimed in claim 2, said guide rail lower ledge having an obliquely disposed guide rail lower ledge roll-in slope proximate said guide rail rear end, said guide rail lower ledge having a bend spaced from the guide rail rear end, and the guide rail lower ledge roll-in slope extending from the bend toward the guide rail rear end in a downwardly inclined direction substantially parallel to said pull-out rail upper ledge roll-in slope, the guide rail having a guide rail stop member engaging said pull-out rail roller in said rearward position of said pull-out rail limiting rearward movement of the pull-out rail relative to the guide rail, the guide rail stop member being formed in the guide rail lower ledge as an upwardly inclined slope extending from the guide rail lower ledge roll-in slope toward the guide rail rear end.

4. The drawer guide as claimed in claim 3, said pull-out rail upper ledge having a downwardly depending pull-out rail upper ledge flange engaging said guide rail roller.

5. The drawer guide as claimed in claim 4, said guide rail lower ledge having an upwardly extending guide rail lower ledge flange engaging said pull-out rail roller.

6. The drawer guide as claimed in claim 5, said guide rail upper ledge having a downwardly depending guide rail upper ledge flange, the guide rail upper ledge flange and said guide rail lower ledge flange cooperatively engaging said pull-out rail roller.

7. The drawer guide as claimed in claim 6, said guide rail roller being mounted proximate said guide rail front end.

8. The drawer guide as claimed in claim 7, said pull-out rail roller being mounted proximate said pull-out rail rear end.

9. The drawer guide as claimed in claim 8, said guide rail having a generally C-shaped cross section.

10. The drawer guide as claimed in claim 9, said pull-out rail having a generally Z-shaped cross section.

* * * * *